US005597124A

United States Patent [19]

Kessel et al.

[11] Patent Number: 5,597,124

[45] Date of Patent: Jan. 28, 1997

[54] PARTICLE SIZE REDUCTION

[75] Inventors: Werner Kessel, Fellbach; Eckart Ruopp, Metzingen, both of Germany

[73] Assignee: EVT Energie- und Verfahrenstechnik GmbH, Stuttgart, Germany

[21] Appl. No.: 208,619

[22] Filed: Mar. 9, 1994

[30] Foreign Application Priority Data

Mar. 13, 1993 [DE] Germany ..... 43 08 042.1

[51] Int. Cl.[6] ..... B02C 15/04

[52] U.S. Cl. ..... 241/30; 241/121; 241/291

[58] Field of Search ..... 241/30, 119, 121, 241/291, 300

[56] References Cited

U.S. PATENT DOCUMENTS

| | | | |
|---|---|---|---|
| 4,067,503 | 1/1978 | Broman | 241/30 |
| 4,606,506 | 8/1986 | Okada et al. | 241/109 |
| 4,611,765 | 9/1986 | Shimojima et al. | 241/121 |
| 4,679,739 | 7/1987 | Hashimoto et al. | 241/121 |
| 4,981,269 | 1/1991 | Koga et al. | 241/30 |
| 5,518,192 | 5/1996 | Hamaguchi | 241/121 |

FOREIGN PATENT DOCUMENTS

| | | | |
|---|---|---|---|
| 1227762 | 10/1966 | Germany | 241/121 |

*Primary Examiner*—John M. Husar
*Attorney, Agent, or Firm*—Chilton, Alix & Van Kirk

[57] ABSTRACT

A process for determining the profile of the surface of the lining of the grinding bowl of a rolling mill in which the constant change in the angle α of the grinding bowl that is necessary for accelerating transport of the product being ground is calculated as a correlation of the distance to the turning point of the rolling mill for several radii, the frictional value between the grinding rolls and the grinding bowl lining and the rotational speed of the grinding bowl being constant values in calculation.

4 Claims, 2 Drawing Sheets

PARTICLE SIZE REDUCTION

BACKGROUND OF THE INVENTION

1. Field of the Invention

The present invention relates to the pulverization of particulate matter and especially to enhancing the efficiency of bowl mills which are employed in the grinding of coarse solid material such as coal. More specifically, this invention is directed to a method for determining the optimum profile of the active surface of the grinding bowl of a rolling mill and to pulverizers having a bowl surface profile determined in accordance with such method. Accordingly, the general objects of the present invention are to provide novel and improved methods and apparatus of such character.

2. Description of the Prior Art

While not limited thereto in its utility, the present invention is particularly well suited for use in connection with the pulverization of coal. Pulverized coal entrained in a stream of carrier gas is widely employed as fuel in the burners of steam generators. An example of a prior art bowl mill may be seen at pages 11–24 and 16—16 of the text "COMBUSTION ENGINEERING" by Glenn R. Fryling, 1st Edition, published by Combustion Engineering, Inc. in 1966.

In the operation of a bowl mill, the coal to be ground is delivered to the center of a revolving bowl. Centrifugal forces resulting from bowl rotation cause the coal to move outwardly to the face of a grinding ring portion of the bowl where it is crushed by rotating rolls. The rotating rolls are biased toward the grinding ring either by means of hydraulic actuators or by adjustable pressure springs. The cooperation between the rotating rolls and revolving bowl reduces the size of the coal particles. In the typical bowl mill, a single pass of coal between the rolls and grinding ring produces partial pulverization, the degree of pulverization depending upon the conditions of the grinding elements and the characteristics of the particular coal which is being ground. The pulverized coal is thrown from the bowl rim into an annular hot air passage which surrounds the bowl. The pulverized coal is thus entrained in an air stream and delivered to a "classifier". The classifier will cause particles which have passed through the grinding zone but are too large for use in the firing of the steam generator to be returned to the bowl for regrinding.

The desired mode of operation of a bowl mill is to have the coal or other feed stock, i.e., the product, move to the outer edge of the grinding bowl at an adjusted speed. In prior art bowl mills, assuming that the weight of the product, the inclination of the wall of the grinding bowl relative to its axis of rotation and the direction and force of the air currents which are in part responsible for conveying the reduced product are all constants, the movement of the product will be dependent upon the coefficient of friction between the product and the bowl. Restated, it will be the coefficient of friction which determines whether the pulverized coal moves to the outside of the bowl at an adjusted speed as desired, or whether the product either "shoots through" the grinding zone or is pressed back into the middle of the bowl. For a further discussion of the mode of operation of bowl mills, reference may be had to the periodical "Aufbereitungs—Technik", No. 8, 1975, pages 401–408.

The grinding performance of a bowl mill, i.e., mill efficiency, decreases when the product "shoots through" the grinding zone. This decrease in performance results from the fact that, as briefly noted above, coarse-grained product will be separated and returned the grinding bowl where it must again pass between the rollers and grinding ring face. It should also be noted that when a significant quantity of the product "shoots through" the grinding zone, the height of the layer of product between the bowl and rollers is not sufficient to guarantee quiet running of the mill, i.e., there is no "cushion", and mill oscillations may occur. In the operation of a bowl mill, oscillations must be avoided in the interest of safety and to prolong mill service life while excessive operating noise is a matter of constant concern.

SUMMARY OF THE INVENTION

The present invention overcomes the above-briefly discussed deficiencies and other disadvantages of the prior art and, in so doing, ensures against an undesirable reduction in the grinding bed height, i.e., the thickness of the layer of material moving along the bowl surface in the grinding zone. In accordance with the present invention, the profile of the surface of the lining of a rolling mill is selected so as to ensure that the product being ground moves to the outer edge of the grinding bowl at the desired adjusted speed. Specifically, the angle of inclination of the wall of the grinding bowl necessary for accelerating transport of the product is calculated as a correlation of the distance to the axis of rotation of the bowl for several radii. In performing this calculation, the frictional value between the grinding rolls and the bowl lining and the rotational speed of the bowl are selected to be constants.

BRIEF DESCRIPTION OF THE DRAWINGS

The present invention may be better understood, and its numerous objects and advantages will become apparent to those skilled in the art by reference to the accompanying drawings wherein.

DESCRIPTION OF THE DISCLOSED EMBODIMENT

Figure 1:
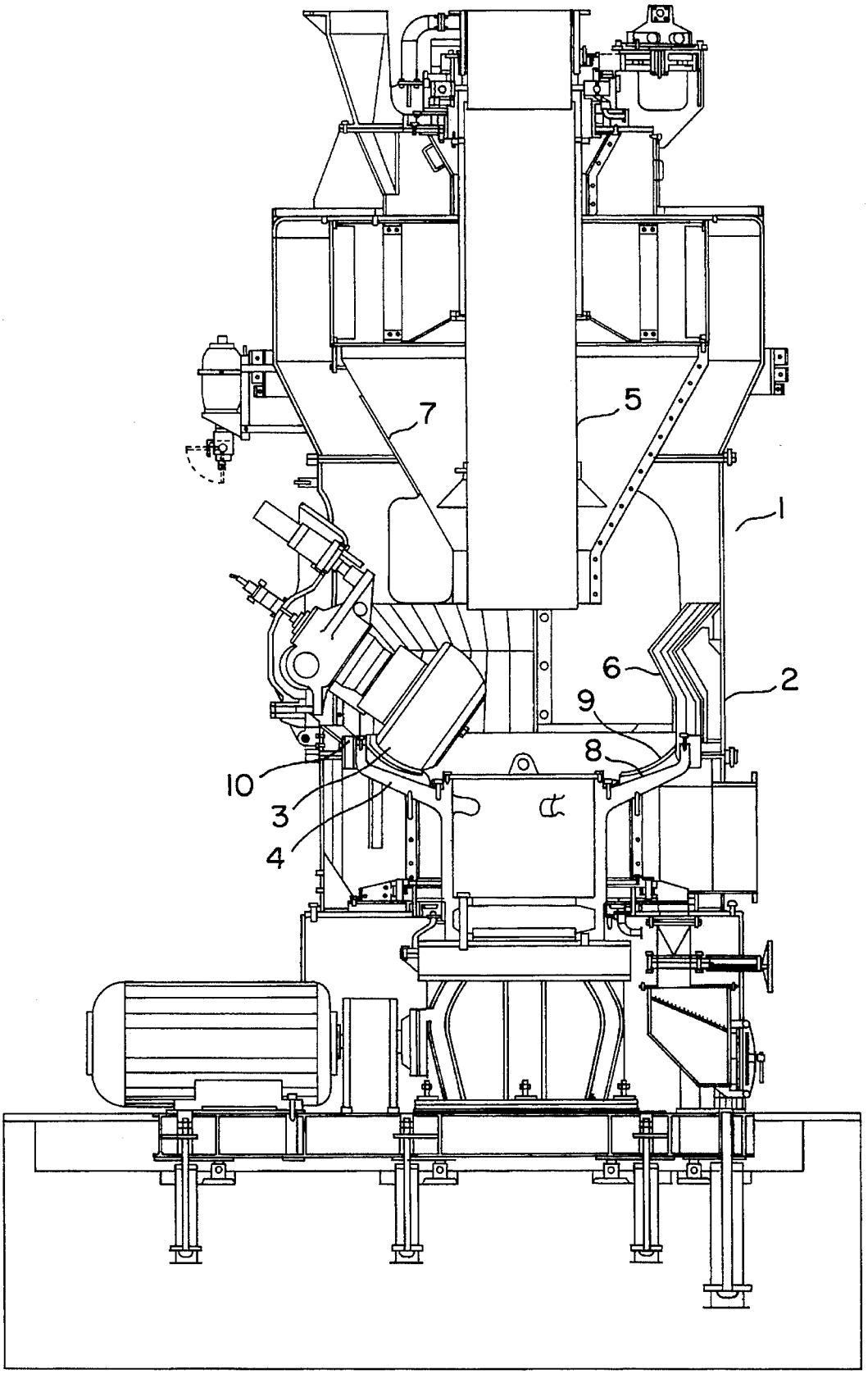
FIG. 1 is a schematic, cross-sectional, side elevation view of a rolling mill to which the present invention may be applied.

With reference to FIG. 1, a rolling mill is indicated at 1. Mill 1 has a housing 2 which defines a generally sealed enclosure in which the pulverizing operation occurs. Raw coal and hot air are delivered to enclosure defined by housing 2 and pulverized coal entrained in an air stream is discharged from the enclosure. In operation, coal is fed to the grinding bowl 4 of mill 1 from a distributor, not shown, through a centrally located gravity feed conduit 5. The rate of delivery of coal to bowl 4 is, of course, controlled. The bowl 4 is provided with a lining 8. The bowl 4 is caused to revolve about a central axis and, accordingly, the coal delivered to the middle of bowl 4 is thrown to the outside of the bowl by centrifugal force. As the coal moves outwardly and upwardly in response to centrifugal force and inflowing hot air, it is directed under the mill rolls 3 by a deflection hood 6. In FIG. 1, at the right side of the bowl, the operational relationship between the bowl lining 8 and the grinding surface 9 of a roll 3 may be clearly seen.

The pulverized product which moves to the outer edge of the bowl 4 is entrained in hot air which is delivered through a nozzle ring 10. This hot air both dries the pulverized coal and carries the coal "dust" into a classifier 7. In classifier 7, the coarser particles are separated from the air/coal dust stream and returned into bowl 4 for regrinding. The coal dust which is sufficiently fine will remain entrained in the air stream and will flow out of housing 2 and be delivered to the burners of a steam generator, not shown.

Figure 2:
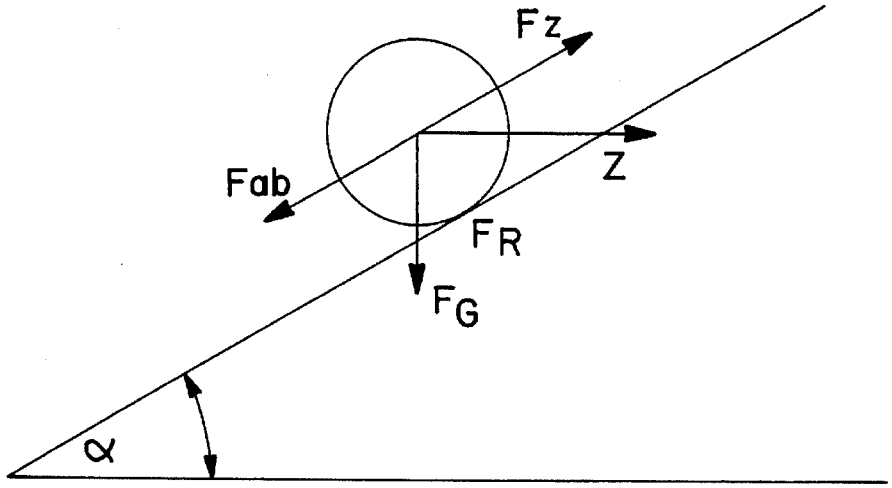
FIG. 2 graphically depicts the forces on coal particles being pulverized in the mill of FIG. 1.

FIG. 2 graphically depicts the balance of the forces on the coal particles in a grinding bowl having an inner surface inclined at an angle of incidence α. The relationship of the equilibrium of forces for the radial movement of the coal to the outside edge of the bowl gives a minimum necessary centrifugal acceleration of:

$$a_{z\,min.} = g\,\frac{\sin\alpha + \mu\cos\alpha}{\cos\alpha - \mu\sin\alpha} \tag{1}$$

where:

g=9.81 m/s$^2$ ground acceleration

μ=frictional value (0.5<μ<0.9)

$a_{z\,min.}$=minumum centrifugal acceleration m/s$^2$

The equilibrium of forces is as follows:

$$F_z = F_{ab} + F_R \tag{2}$$

where:

$F_z$=centrifugal force of component $F_{ab}$=coal weight of component $F_R$=frictional force of coal particles Therefore:

$$\cos\alpha \times M \times a_z = \sin\alpha \times M \times g + \mu \times \cos\alpha \times M \times g + \mu \sin\alpha \times M \times a_z \tag{3}$$

where:

M=mass of coal particles

The prevailing centrifugal acceleration $a_z$ on the grinding bowl turning at constant angular speed ω comes out to:

$$a_{z\,actual} = r \times \omega^2 = r\,\frac{(\pi n)^2}{30} = f(r) \tag{4}$$

where:

r=distance to axis of rotation n=rotational speed of bowl (in rpms)

As the distance to the axis of rotation increases, the prevailing centrifugal acceleration $a_{z\,actual}$ becomes increasingly dependent on the minimum centrifugal acceleration $a_{z\,min.}$, the frictional value μ and the angle of incidence α of the grinding bowl. Accordingly, adjustment of the grinding bowl contour over the radius, i.e., a constant change in the angle α of the grinding bowl, as a function of distance to the axis of rotation allows the prevailing centrifugal acceleration $a_{z\,actual}$ to be synchronized with the necessary transport acceleration. A reduction in grinding bed height may thus be counteracted by radial acceleration increasing over the radius and, with it a disproportionately increasing transport speed from inside to the outside of the bowl.

In accordance with the invention, the grinding rolls 3 are designed to be generally barrel-shaped in order to correspond to the contour of the bowl 4.

Figure 3:
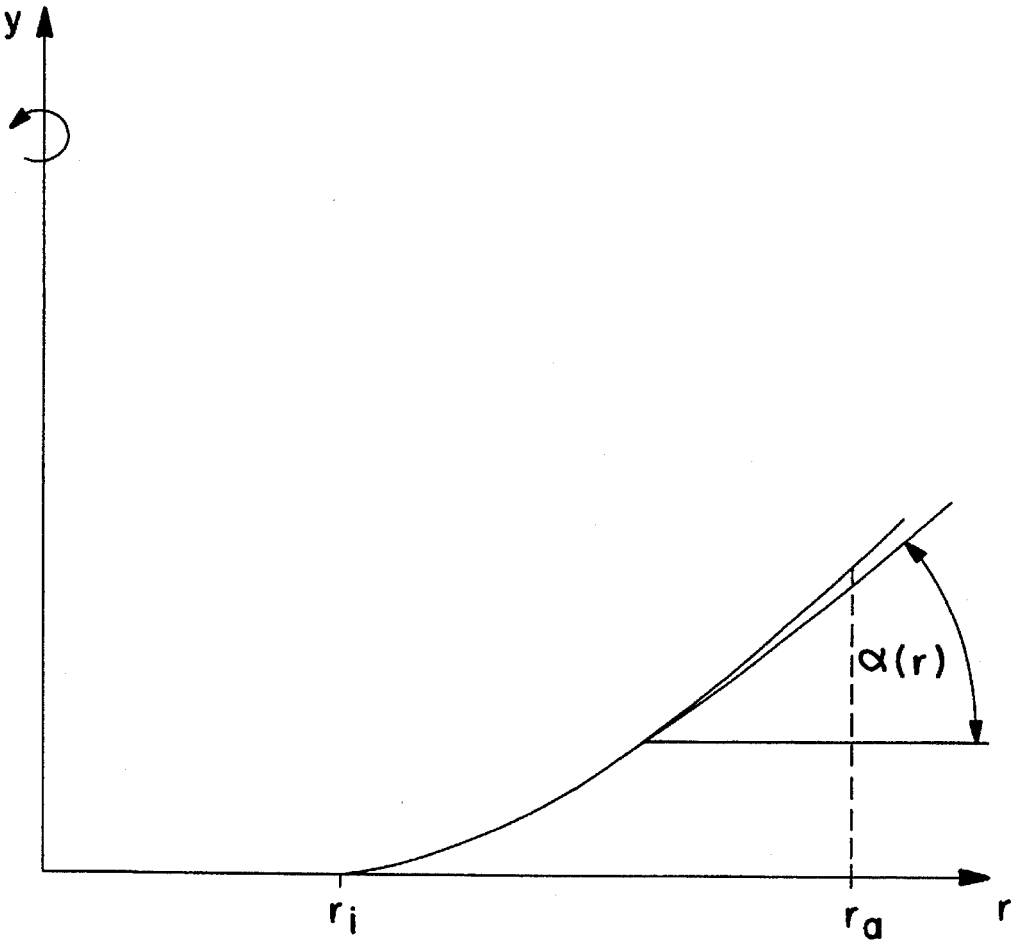
FIG. 3 is a graphical depiction of the profile of the lining of the grinding bowl of a rolling mill in accordance with the invention.

Referring to FIG. 3, the grinding bowl contour can be calculated as follows either by:

$$\alpha(r) = \arctan\frac{\frac{\omega^2}{g}\times r - \mu}{\frac{\mu\omega^2}{g}\times r + 1} \tag{5}$$

or $$y(r) = \frac{r}{\mu} - \frac{g}{\omega^2}\times\left(1+\frac{1}{\mu^2}\right)\times \ln\left(\frac{\omega^2}{g}\mu r + 1\right) + \frac{g}{\omega^2}\times\left(1+\frac{1}{\mu^2}\right)\times \ln\left(\frac{\omega^2}{g}\mu r i + 1\right) - \frac{ri}{\mu} \tag{6}$$

While preferred embodiments have been described, various modifications and substitutions may be made thereto without departing from the spirit and scope of the invention. Accordingly, it is to be understood that the present invention has been described by way of illustration and not limitation.

What is claimed is:

1. In a bowl mill, the mill having a revolving grinding bowl and a plurality of rotatable grinding rolls which cooperate with the bowl to define a grinding zone therebetween, the improvement comprising the bowl surface in the grinding zone having a profile characterized by an angle of inclination relative to the axis of bowl rotation which constantly changes, the variation in the inclination angle being at least in part a function of the radial distance to the axis of rotation.

2. The apparatus of claim 1 wherein the angle of inclination of the bowl surface in the grinding zone varies in accordance with:

$$\alpha(r) = \arctan\frac{\frac{w^2}{g}\times r - \mu}{\frac{\mu w^2}{g}\times r + 1}$$

where:

r=distance to axis of rotation g=9.81 m/s$^2$

μ=frictional value (0.5<μ<0.9)

w=angular speed.

3. The apparatus of claim 1 wherein the angle of inclination of the bowl surface in the grinding zone varies in accordance with:

$$y(r) = r/\mu - g/\omega^2 \times (1+1/\mu^2) \times \ln(\omega^2/g\mu r + 1) + g/\omega^2 \times (1+1/\mu^2) \times \ln(\omega^2/g\mu r i + 1) - ri/\mu.$$

4. A process for determining the profile of the roll surface of the lining of the grinding bowl of a rolling mill characterized by the fact that a constant change in the angle α of the grinding bowl necessary to accelerate the movement of the product through a grinding zone is calculated as a function of the distance to the turning point of the rolling mill for several radii, wherein the frictional value between the grinding rolls and the lining of the grinding bowl and the rotational speed being selected of the grinding bowl as constant values in the calculation.

* * * * *